US005847647A

United States Patent [19]

Devine

[11] Patent Number: 5,847,647

[45] Date of Patent: Dec. 8, 1998

[54] MICRO MOVABLE ALARM

[76] Inventor: James Brian Paul Devine, 24 Knightsbridge Road, Scarborough, Ontario, Canada, M1L 2B2

[21] Appl. No.: 749,639

[22] Filed: Nov. 15, 1996

[51] Int. Cl.[6] ..... G08B 13/14

[52] U.S. Cl. ..... 340/571; 340/566; 340/669; 340/689

[58] Field of Search ..... 340/571, 566, 340/669, 689

[56] References Cited

U.S. PATENT DOCUMENTS

| | | | |
|---|---|---|---|
| 4,747,216 | 5/1988 | Kelly et al. | 340/689 |
| 5,153,561 | 10/1992 | Johnson | 340/571 |
| 5,153,566 | 10/1992 | Yun | 340/689 |
| 5,317,304 | 5/1994 | Choi | 340/571 |

*Primary Examiner*—Glenn Swann

[57] ABSTRACT

An alarm for detecting the unauthorized movement of an object includes a motion detector, programmable microprocessor and an audible alarm contained within a housing. The motion detector utilizes a series of radially extending electrical contacts together with a peripheral electrical contact ring that encircles the perimeter of the outside edges of the radially extending electrical contacts. A metallic ball is provided within the electrical contact ring and is of sufficient size that it can roll freely within the interior of the ring. The programmable microprocessor has a key pad for programming the processor to detect when an electrical circuit is formed by said contact ring, ball and any radially extending contact and to detect when this circuit is broken by movement of the object. The audible alarm sounds when the electrical circuit is broken. The microprocessor and motion detector are mounted on a first circuit board and the key pad is mounted on a second circuit board mounted above the first circuit board within the housing.

7 Claims, 8 Drawing Sheets

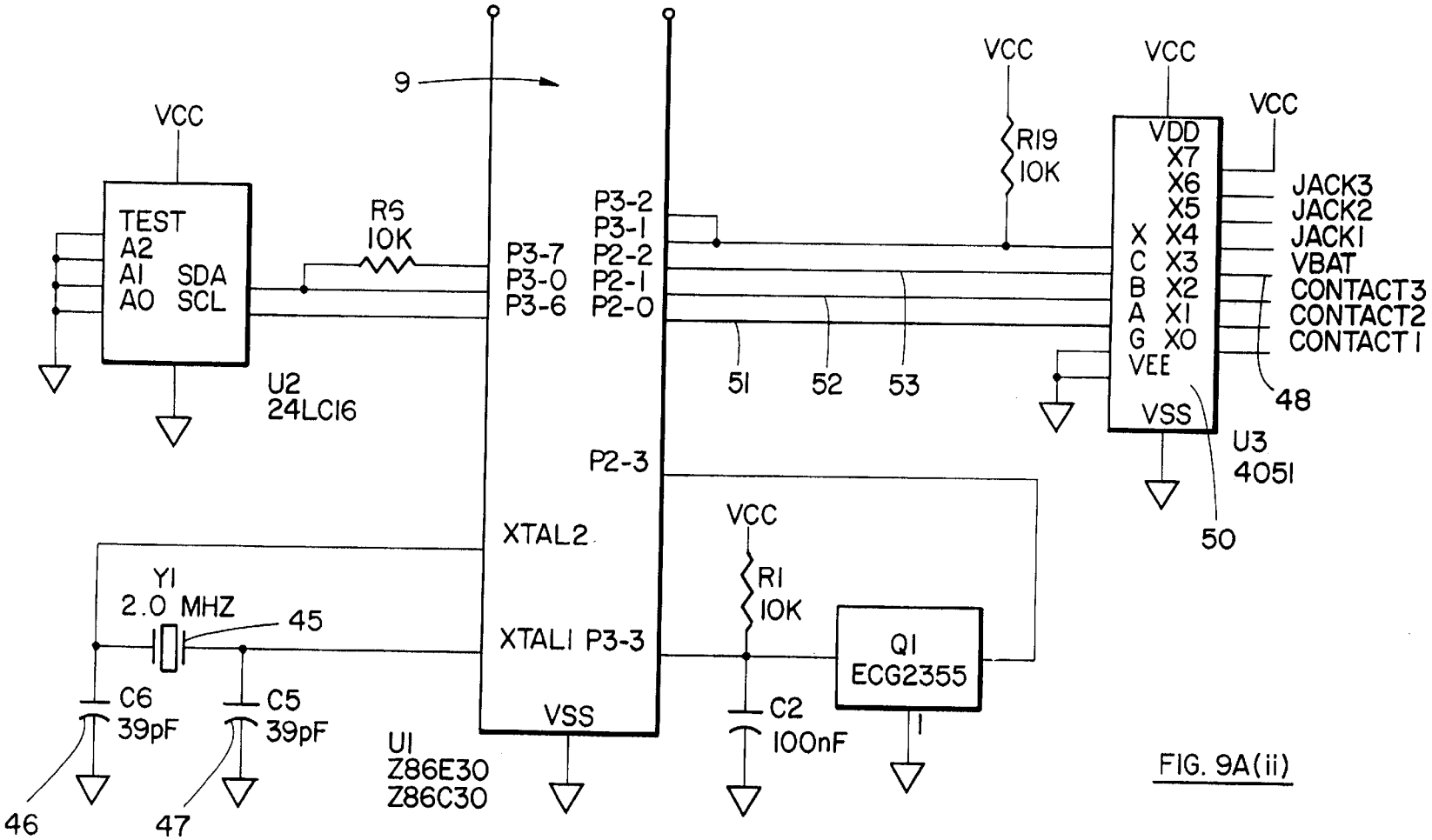
FIG. 9A(ii)

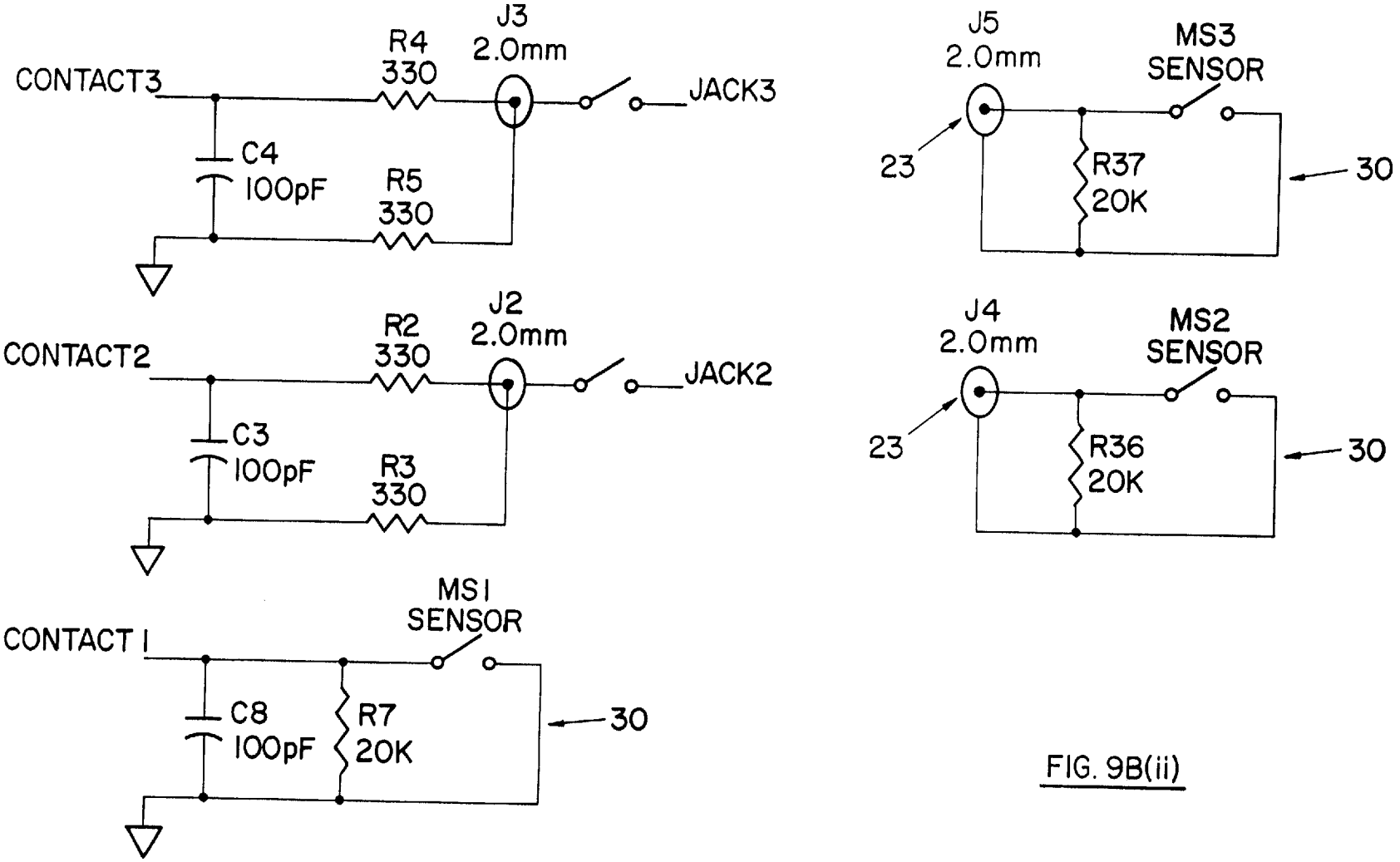
FIG. 9B(ii)

MICRO MOVABLE ALARM

BACKGROUND OF THE INVENTION

1. Field of the Invention

This invention relates to security systems and, more particularly, to micro alarm devices designed to be attached to valuable property items.

2. Description of the Prior Art

Security and alarm systems and devices for protecting premises and property are known. Residential and commercial properties are increasingly protected by alarm systems that sound an alarm on unauthorized entry into the premises by either or both detecting the opening of a door or window or motion in the premises. However where the police or security service responds to the alarm there is a time delay between unauthorized entry and arrival time in which valuable items can be removed from the premises.

The alarm of the present invention is a new and innovative concept in security for home or office. The concept of the present invention is to attach the alarm to valuable property. If the item is moved the motion detector triggers an alarm causing an intruder to not remove the protected item. The micro alarm of the present invention is compatible with other security systems detecting unlawful entry to the premises.

SUMMARY OF THE INVENTION

It is an object of the invention to provide a simple and effective motion detection means.

It is a further object of the invention to provide an alarm device that can be attached to valuable items that will sound an alarm if the item is moved.

Thus, in accordance with the present invention, there is provided motion detection means adapted for connection to a moveable object comprising a series of radially extending electrical contacts and a peripheral electrical contact ring that encircles the perimeter of the outside edges of the radially extending electrical contacts. A metallic ball is provided within the electrical contact ring and is of sufficient size that it can roll freely within the interior of the ring. When the detection means is stationary, the ball tends to come to rest in a position against the contact ring while touching one or more of said radially extending contacts to form an electrical circuit. The motion detection means includes means to detect when an electrical circuit is formed by the contact ring, ball and any radially extending contact and to detect when this circuit is broken by movement of the object. A housing is preferably provided to shield the detection means from outside interference such as magnetic fields etc.

In another embodiment the present invention provides an alarm for detecting the unauthorized movement of an object said alarm comprising a motion detection means and an audible alarm means. The motion detection means comprises a series of radially extending electrical contacts together with a peripheral electrical contact ring that encircles the perimeter of the outside edges of the radially extending electrical contacts. A metallic ball is provided within the electrical contact ring and is of sufficient size that it can roll freely within the interior of the ring. When the object to which the motion detection means is attached is stationary, the ball will tend to come to rest in a position against the contact ring while touching one or more of the radially extending contacts to form an electrical circuit. Means are provided to detect when an electrical circuit is formed by the contact ring, ball and any radially extending contact and to detect when this circuit is broken by movement of the object. The means to detect when an electrical circuit is formed or broken preferably consists of a programable control microprocessor and input means for programming said processor.

When the object is moved while the alarm is the armed state the audible alarm means sounds when said electrical circuit is broken. In order to act as an effective deterrent the audible alarm means is preferrably a piezo alarm.

The alarm can be adapted for external mounting to an object or installed internally such as in a computer or television. If intended to be mounted externally the alarm includes an external housing having front, rear side and end walls and the input means is a key pad. Where the alarm is adapted for installation within an object the input means may consist of a control pad or key board connected to the object.

The alarm can be attached to valuable items such as televisions, stereo systems, VCR's, video cameras, computers etc. When the alarm is armed it will sense any motion of the item to which it is attached and will sound an alarm if sufficient motion has been detected.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
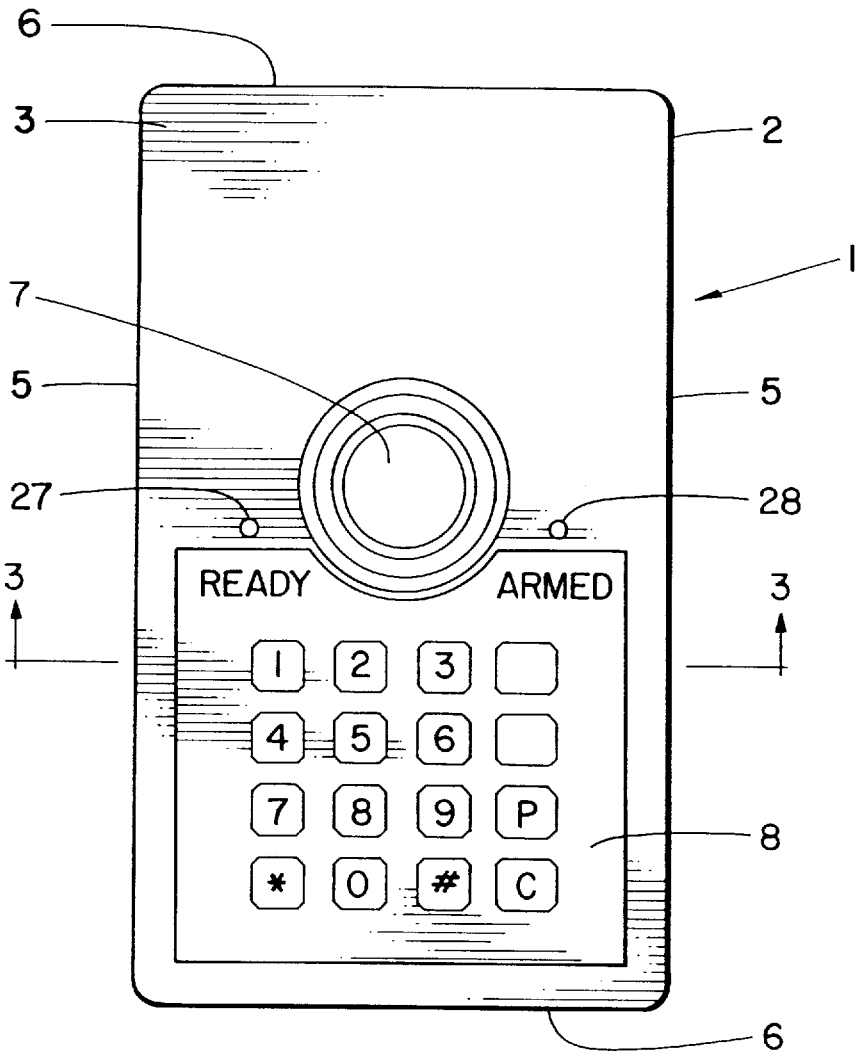
FIG. 1 is a front plan view of a micro alarm according to the present invention.
Figure 2:
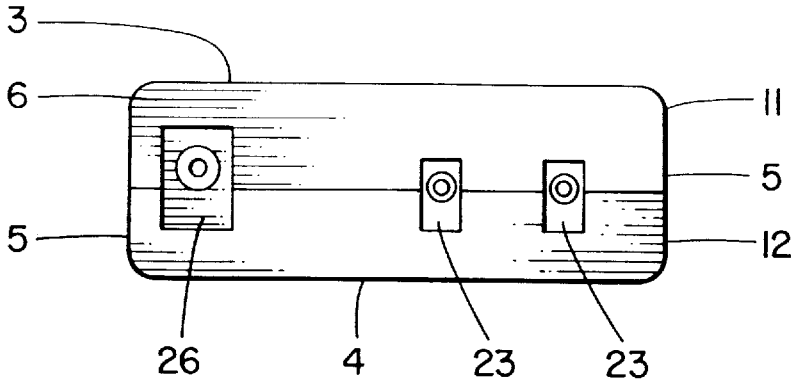
FIG. 2 is an end view of the micro alarm of FIG. 1.

Referring to the Figures, a preferred embodiment of a micro alarm according to the present invention is generally indicated at 1. The micro alarm of the present invention is intended to be attached to an object either internally (not shown) or externally (as shown in the Figures) and sound an alarm when the object is moved. Micro alarm 1 consists of a housing 2 having front, rear, side and end walls 3, 4, 5 and 6 respectively, an audible alarm means 7, preferably a piezo alarm, a key pad 8, microprocessor 9 and motion detection means 10. Key pad 8 consists of keys one through nine plus zero, an asterisk (*) key, a pound sign (#) key and two spare unused keys. Key pad 8 is used to enter either a Personal Identification Number (PIN) or a programming sequence. The asterisk key (*) is used to clear previous entries. The pound sign (#) is used to signal to microprocessor 9 that a programming sequence is being entered. If the micro alarm is installed within an object such as a computer or television there may be no requirement to provide the external housing 2 or key pad 8. If the micro alarm is connected within a television or computer for example, the remote control or channel key pad on the television or key board with the computer could be substituted for key pad 8.

Figure 3:
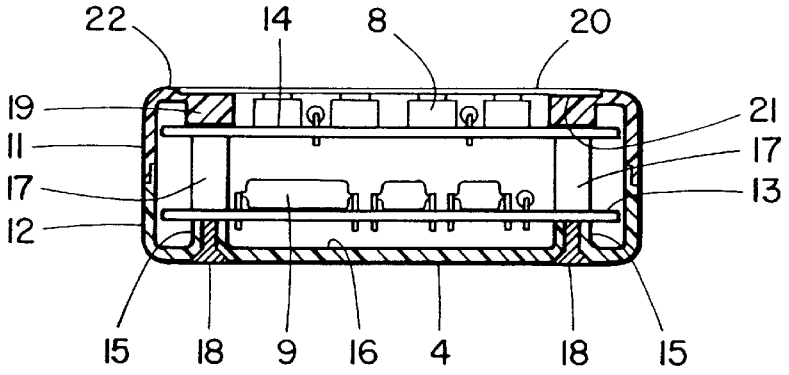
FIG. 3 is cross section along lines 3—3 in FIG. 1.
Figure 4:
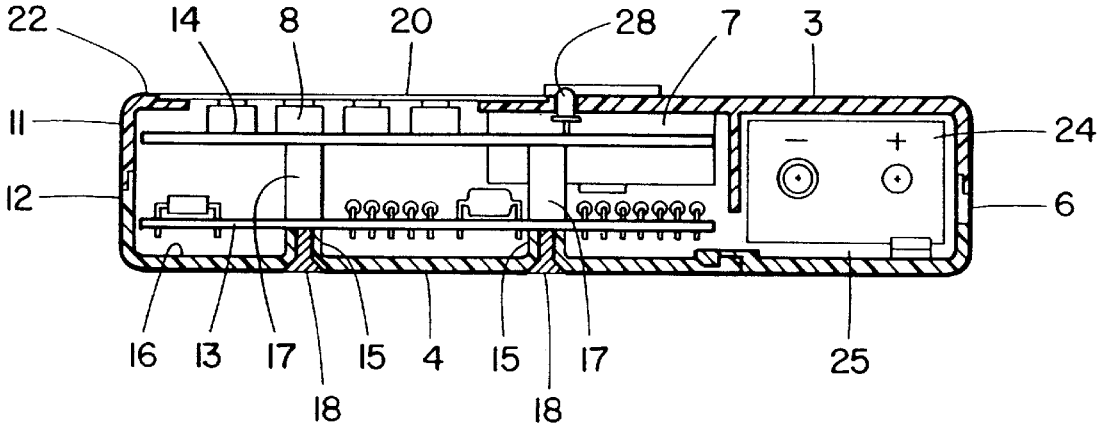
FIG. 4 is side view in cross section of the alarm.

In the preferred embodiment housing 2 is fabricated in two parts an upper section 11 and lower section 12 which when connected together form housing 2 containing the other components namely alarm means 7, key pad 8, micro processor 9 and motion detection means 10. As best illustrated in FIGS. 3 and 4, in the preferred embodiment the micro processor 9 and motion detection means 10 are preferably mounted on a first circuit board 13. Programmable key pad 8 is mounted on a second circuit board 14.

The first circuit board 13 is mounted on stops 15 on the inside surface 16 of lower housing section 12. The second circuit board 14 is mounted above the first circuit board 13 using spacers 17 between the circuit boards and matching tabs 19 on the upper section of the housing which permit a mechanical fastener 18 to retain both circuit boards on stops 15. By utilizing two circuit boards a compact design can be obtained. Alternatively where compact size is not a necessary feature a single circuit board could be utilized for all the electrical components. The second circuit board 14 is mounted so that key pad membrane 20 which overlays key pad 8 is mounted on recesses 21 so that it is flush with the top surface 22 of the upper housing section 11.

The micro alarm may be powered by connecting, via an AC adaptor to power jack 26 located on one end of housing 2, to a standard 120 volt AC outlet. Alternatively or additionally as a backup in the case of a power failure, battery compartment 25 is provided in which a 9 Volt battery 24 can be inserted to power alarm 1. Green LED 27 and red LED 28 may be provided on the front of alarm 1 to indicate whether alarm 1 is armed or disarmed. A single LED display could also be used in place of LEDs 27 and 28 to indicate if alarm 1 was in an armed or disarmed condition. Red LED 28 can indicate either an Alarm or Armed condition.

Figure 8:
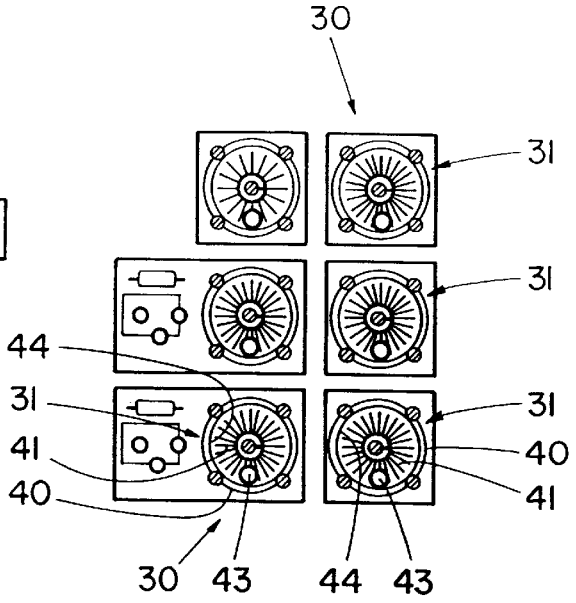
FIG. 8 is a top plan view of extenders having motion detection means for attachment to other components and connected back to the alarm system.
Figure 9A:
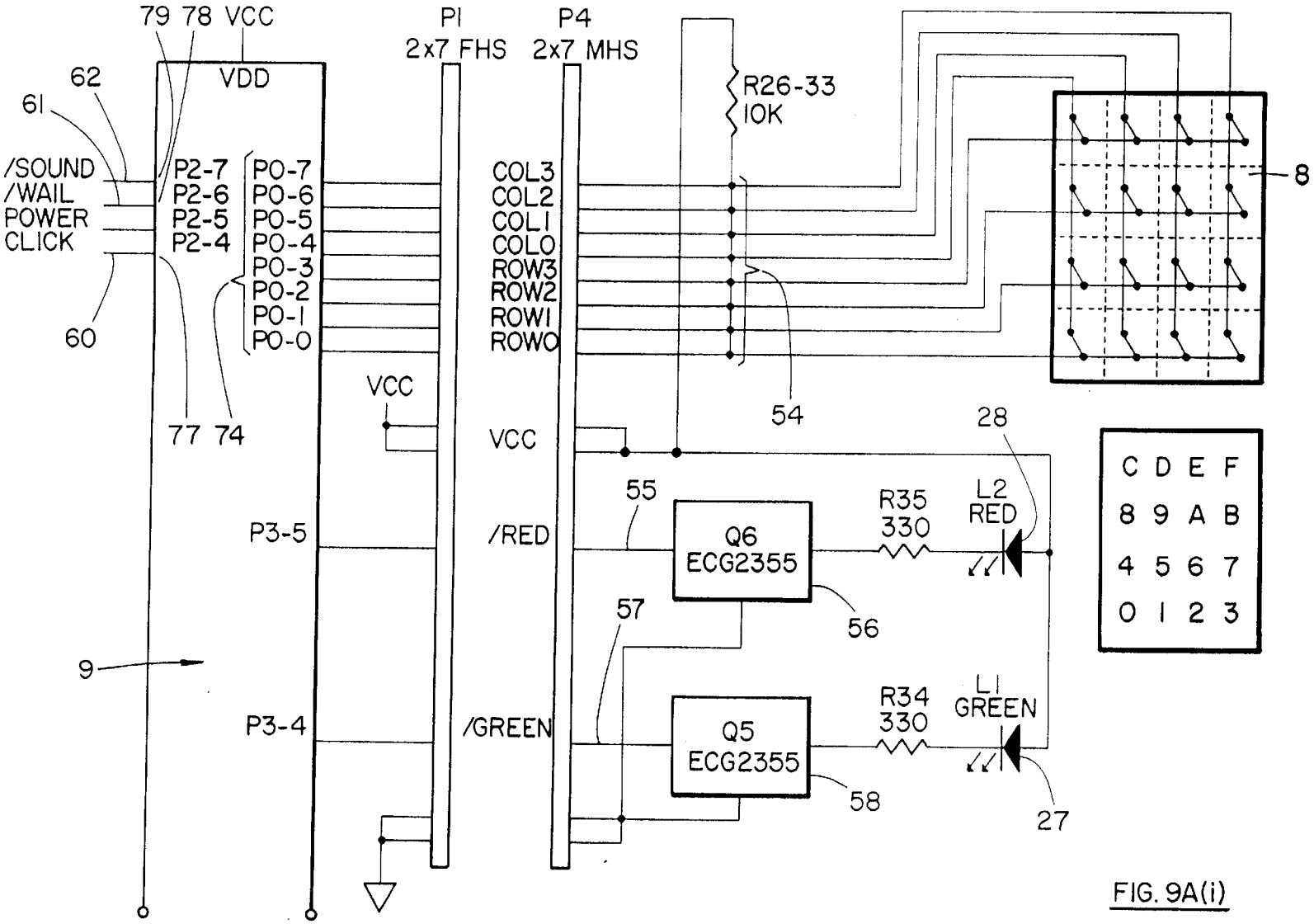
FIG. 9A consisting of FIGS. 9A(i) and 9A(ii), FIG. 9B consisting of FIGS. 9B(i) and 9B(ii) and FIG. 9C are the schematic outlines of the circuitry for the micro alarm of the present invention.
Figure 9B:
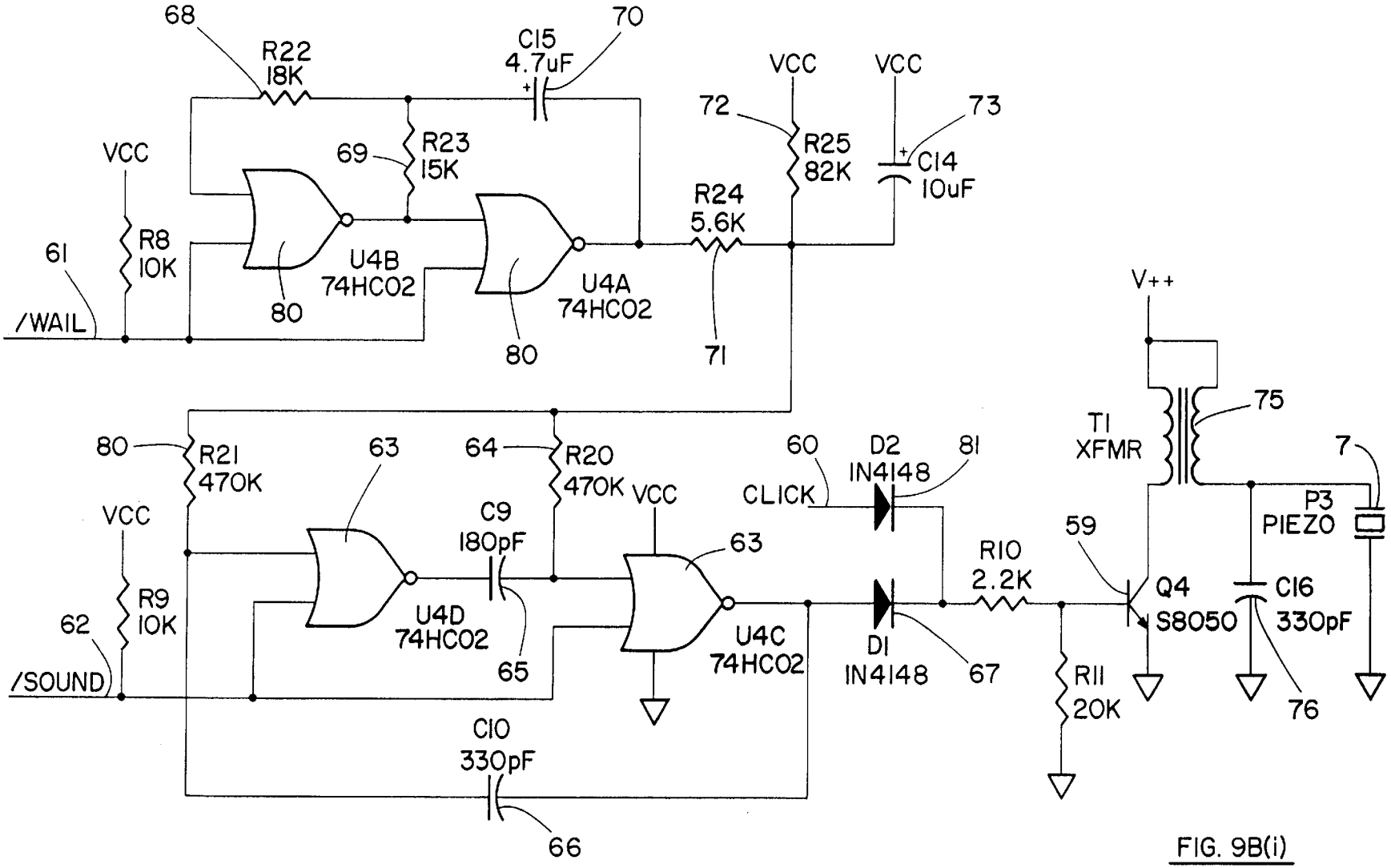
Figure 9C:
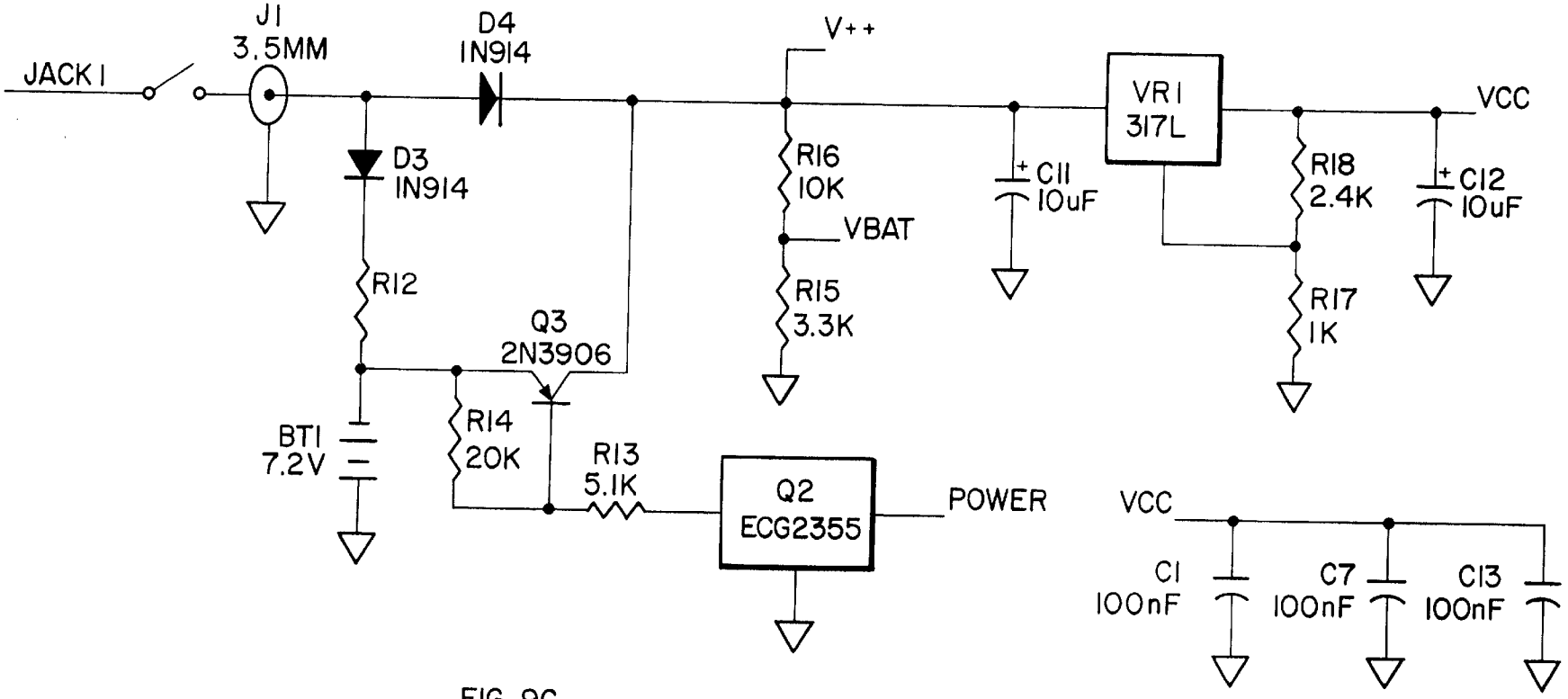

More than one item can be protected with alarm 1. Provision is made for one or more extenders 30 (FIG. 8) containing a motion detection means 31 which can be attached to other items and connected by wires through stereo jacks 23 to alarm 1. Other wireless suitable means may be used to relay a breach of security conditions from the remote item back to alarm 1 for purposes of sounding an alarm including radio frequency transmission 25 etc.

Figure 6:
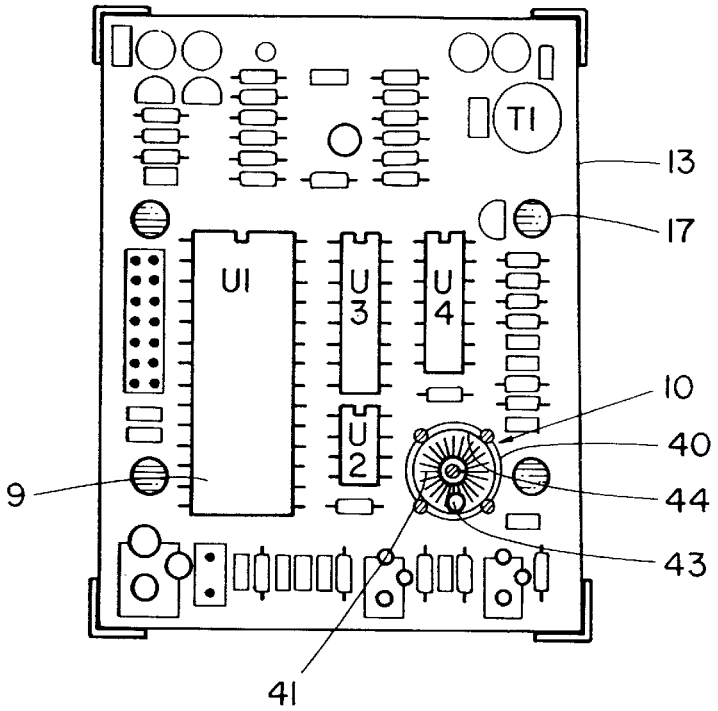
FIG. 6 is a top plan view of a first circuit board containing motion detection means for the micro alarm of FIG. 1.
Figure 7:
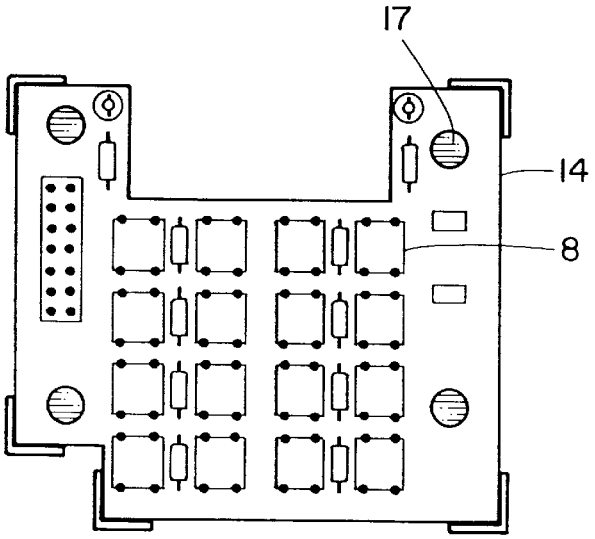
FIG. 7 is a top plan view of the key pad circuit board for the present invention.

The motion detection means 10 of the present invention in the preferred embodiment (FIG. 6) consists of a circular housing 40 which will shield the detection means from outside interference such as magnetic fields etc. A series of radially extending electrical contacts 41 extend from an interior metallic ring 44 within the housing 40. Metallic ring 44 is located above contacts 41 and encircles the perimeter of the outside edges of contacts 41. Metallic ball 43 is provided within the housing and is of sufficient size such it that can roll freely within the interior of ring 44 and cannot pass between ring 44 and contacts 41. Ball 43 will tend to come to rest in a position against ring 44 while touching one or more of contacts 41. The control program detects when an electrical circuit is formed by ring 44, ball 43 and any contact 41 and detects when this circuit is broken. When the alarm is in the armed condition, the control program detects and counts the instances of a break of the electrical circuit. The sensitivity of alarm 1 can be adjusted by two methods: first, by adjusting the frequency of movement checks by the program and second by adjusting the count number required to trigger alarm 1. A similar detection means is used for the extenders 30.

Figure 5:
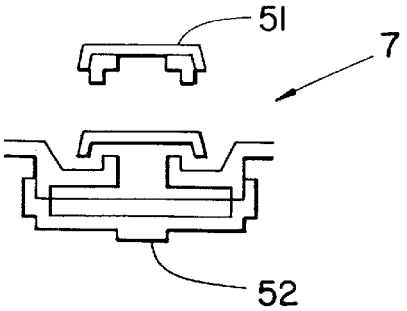
FIG. 5 is a cross sectional view of the piezo of the present invention.

The alarm means as noted is preferably a piezo alarm. The piezo alarm will issue a tone of approximately 130 dB which will startle any unauthorized person moving the item. The unauthorized person will typically leave without removing the item to which alarm 1 is attached. The piezo alarm (FIG. 5) consists of a piezo sound cone 51 and cap 52. Sound cone 51 is located alone mounted on the first circuit board 13. Cap 52 covers the piezo on the front of the housing.

The main control element of alarm 1 is microprocessor 9. The preferred embodiment uses the Z8681 from Zilog. The Z8681 is a low-power microcontroller which has two timers and programmable input and output channels. Other embodiments may use other microprocessors to provide additional features further than those described in this invention. Microprocessor 9 monitors the signals from key pad 8, motion sensors 10 and external jacks 23. Piezo alarm 7 is also controlled by the microprocessor. Crystal 45 and capacitors 46 and 47 generate the clock signal for microprocessor 9. For clarity, ancillary components such as noise filtering capacitors and pull-up resistors are not described herein.

Motion sensors 10, external jacks 23 and battery signal 48 are connected to microprocessor 9 through multiplexor 50. Multiplexor 50 is a commercially available CMOS 4051 component. Data lines 51, 52 and 53 of microprocessor 9 are connected to control lines A, B and C of multiplexor 50, thereby enabling microprocessor 9 to control the output of multiplexor 50.

The row and column signals 54 of key pad 8 are connected to data input lines 74 of microprocessor 9. Output line 55 from microprocessor 9 triggers transistor 56 which drives Red LED 28. Output line 57 from microprocessor 9 controls transistor 58 which drives Green LED 27.

Piezo 7 is driven by the circuit of transistor 59, transformer 75 and capacitor 76. Transistor 59, in turn, is controlled by signals CLICK 60, /WAIL 61 and /SOUND 62 from output lines 77, 78 and 79 of microprocessor 9. CLICK 60 is rectified through diode 81. /SOUND 62 is buffered through two XOR gates 63 and network comprising resistors 80 and 64, capacitors 65 and 66 and diode 67. WAIL 61 is buffered through the same network and two XOR gates 80 and network comprising resistors 68, 69, 71 and 72 and capacitors 70 and 73.

The program contained within the Z8681 controls all functions of alarm 1. The program comprises the following modules: Initialization, Unarmed, Armed, Disarmed and Alarm. Each module is described in turn.

The Initialization module is executed by the microprocessor when alarm 1 is turned on. This module resets all internal program variables used by the microprocessor and executes diagnostics for certain electrical components, including the internal memories of the microprocessor. A series of internally numbered tests are executed. If any of the tests fail, alarm 1 will not operate as an alarm. Instead alarm 1 will repeatedly flash LED 28 a number of times equal to the number of the internal test that failed.

The Unarm module executes after the Initialization module passed all internal tests. In this module, alarm 1 can only either be armed or programmed. The Unarmed Module first deactivates red LED 28 and activates green LED 27. Next the module monitors for any key pad presses. A key pad buffer stores the sequence of keys pressed. When a key is pressed, a tone is emitted. If the key pressed was a "*", for clear, key pad 8 buffer is cleared. If the key pressed was a "#", for the start of a function call, the microprocessor clears the command buffer and continues to monitor for key pad entries. If key pressed was a digit, then the digit value is stored in the buffer.

The duration of every key press is timed and must be completed within two seconds. Pressing keys too slowly will cause red LED 28 to light to indicate an error.

After each key press, the program determines whether another key press should be expected, or if the number of key presses constitutes a full PIN or command entry. If a full entry has not been made, then the module waits for another key press. If a full entry has been made then the Module first checks the entry against valid PINs. There is one factory set PIN and three user definable PINs. If the entry was a valid PIN then the program jumps to the Armed module. If the entry was an invalid PIN, the module checks the entry against valid function commands. If an invalid function command was entered, red LED 28 is lit to indicate an error, and the program waits for another key entry.

In the Armed module, alarm 1 can either sound the piezo or enter the Disarm module. First, the program the lights red LED 28 continuously to indicate an armed condition and then ensures that the last key press has been released. Once it has been released, the program waits for a programmed amount of time before initializing readings from the motion sensors. Signals from the motion sensors generate interrupts for the microprocessor thereby allowing real-time responses to the signals. If the number of motions sensed by the sensors within the motion time parameter exceeds the motion number parameter for any sensor, the program enters the Alarm mode. If a key is pressed in the Armed mode, the program enters the Disarm mode.

In the Disarm module, alarm 1 can be disarmed. However, if alarm 1 is unsuccessfully disarmed, the program returns to the Alarm module. In this module, the program disregards signals from the motion sensors and waits for key presses. The program causes red LED 28 to flash on and off continuously. When the operator has entered four non-clear key presses, the entered sequence is compared against stored PIN codes. If a valid PIN is entered, the program returns to the Unarmed Module. If an invalid PIN is entered, red LED 28 is lit. The number of PIN entries is monitored by the program. If the number exceeds the maximum number allowed, then the program goes to the Alarm mode.

In this mode, all entries are timed. If the time to enter a PIN exceeds the maximum time allowed, the attempt is considered to be an invalid PIN attempt.

In the Alarm mode, the red LED 28 flashes continuously and the green LED 27 is turned off. Piezo 7 is engaged to sound. In order to disable piezo 7, a valid PIN must be entered on key pad 8. The module scans for key presses which are stored in a key buffer. If the clear key "*" is pressed, the buffer is cleared. A key beep is generated after each key press. Once four digits have been entered, the module checks whether the key sequence comprises a valid PIN. If a valid PIN was entered, green LED 27 is lit, red LED 28 is turned off, piezo 7 is turned off and the program returns to the Unarmed module.

To install and operate alarm 1 the following procedure is used: First, alarm 1 is attached to the item to be monitored using double sided adhesive tape, velcro or other suitable attachment means. 9-volt adaptor and any optional extenders are connected to alarm 1 through jacks 23 and 26 on alarm 1. Double sided tape is used to attach the optional extenders to any additional items to be protected. Next, 9 volt adapter is plugged into a 120 volt AC outlet. Now, alarm 1 is ready to receive commands via key pad 8.

The micro alarm can program the user PINs, Disarming retries, Arming Time Delay and Sensitivity Levels. A programming sequence consists of entering the following key pad key sequences on key pad 8:

1) Pressing the program key (#)
2) Entering the option number (0–9)
3) Entering the option information (0–999)

It can be appreciated that while this program for the microprocessor is unique, the functionality can be replicated using other programming formats, which are not presented in this disclosure, but still form part of the invention.

To set the programmable PINs, the following key sequence is entered on key pad 8: #PXXXX, where P is the PIN to be set and XXXX is the corresponding digits for the PIN. For example, to set PIN 3 to 9573, the following would be entered: #39573.

To set the maximum number of invalid PIN number entries in the Disarm mode, the following key sequence is entered on key pad 8: #4 XX, where XX is between 1 and 99 and sets the limit on unsuccessful PIN entry attempts.

To set the maximum time allowed to enter a PIN is the Disarm mode, the following key sequence is entered on key pad 8: #5 SS, where SS is a time in seconds between 1 and 99 seconds.

Alarm 1 also has a programmable delay time between arming alarm 1 and monitoring of the motion sensors. This allows the operator to move from alarm 1 and the motion sensors to stabilize before alarm 1 enters the Armed mode. To set the delay time, the following key sequence is entered on key pad 8: #6 SS, where SS is a time in seconds between 1 and 99 seconds.

There are two sensitivity variables for alarm 1. The first variable fixes the number of motions recognized by the motion sensors before alarm 1 is activated. A sensitivity of 1 is the most sensitive level since only one sense of motion is necessary to trigger alarm 1 and a sensitivity level of 99 is be the least sensitive level. To set first sensitivity parameter the following key sequence is entered on key pad 8: #7 NN, where NN is a number of motions needed to be detected, between 1 and 99. There is another corresponding sensitivity adjustment for the second motion sensor.

The second sensitivity adjustment sets the time period that alarm 1 uses to monitor for sensor motion. When a first motion is detected, alarm 1 monitors for subsequent motions during the set motion time. When the motion time has elapsed, alarm 1 determines whether the number of motions detected exceeds the value set for the first sensitivity level. If the detected level does exceed the value, alarm 1 is sounded. For example, if sensitivity level #1 was set to 3 movements and motion time was set to 10 seconds alarm 1 would be activated if 3 movements were sensed on sensor #1 during a 10 second time span. To set first sensitivity parameter the following key sequence is entered on key pad 8: #8 NN, where NN is a number of motions needed to be detected, between 1 and 30 seconds.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. An alarm for detecting the unauthorized movement of an object said alarm comprising:

(1) an external housing having front, rear, side and end walls and fabricated in two parts, an upper section and a lower section;

(2) a motion detection means comprising a series of radially extending electrical contacts, a peripheral electrical contact ring that encircles the perimeter of the outside edges of the radially extending electrical contacts, a metallic ball provided within the electrical contact ring and of sufficient size such that it can roll freely within the interior of the ring, said ball tending to come to rest in a position against said contact ring while touching one or more of said radially extending contacts;

(3) a programmable control microprocessor having a key pad for programming said processor, to detect when an electrical circuit is formed by said contact ring, ball and any radially extending contact and to detect when this circuit is broken by movement of the object;

(4) an audible alarm means wherein said audible alarm means sounds when said electrical circuit is broken;

wherein the microprocessor and motion detection means are mounted on a first circuit board and the key pad is mounted on a second circuit board, said second circuit board mounted above said first circuit board within the housing.

2. The alarm according to claim 1 wherein additional motion detection means are provided remote from said alarm.

3. The alarm of claim 1 wherein the alarm means is a piezo alarm.

4. The alarm of claim 3 wherein the a sensitivity adjustment is provided for the motion detection means.

5. The alarm of claim 4 wherein the sensitivity adjustment fixes the number of times the electrical circuit is broken by motion of the ball before the alarm means is sounded.

6. The alarm of claim 5 wherein the sensitivity adjustment includes a set time period in which the electrical circuit is broken two or more times.

7. An alarm according to claim 1 wherein said alarm means is located within the housing above said first circuit board.

* * * * *